United States Patent [19]

Wildey

[11] Patent Number: 4,752,039

[45] Date of Patent: Jun. 21, 1988

[54] SEALING BAR FOR CENTRIFUGAL GRINDERS

[75] Inventor: Allan J. Wildey, Brantford, Canada

[73] Assignee: AMCA International Limited, Brantford, Canada

[21] Appl. No.: 75,949

[22] Filed: Jul. 21, 1987

[30] Foreign Application Priority Data

Jun. 4, 1987 [CA] Canada ..... 538,845

[51] Int. Cl.[4] ..... B02C 19/12

[52] U.S. Cl. ..... 241/275

[58] Field of Search ..... 241/28, 275, 280, 282

[56] References Cited

U.S. PATENT DOCUMENTS 4,401,277 8/1983 Thumm et al. ..... 241/282 X 4,474,335 10/1984 Wildey ..... 241/275 X

*Primary Examiner*—Mark Rosenbaum

*Attorney, Agent, or Firm*—Sim & McBurney

[57] ABSTRACT

A centrifugal grinder for pulp wood and wood chips has a stationary internal grinding surface and a rotor rotating within the surface. The rotor has an axial feed passage for stock to be ground, and at least one passageway extending from the passage to the grinding surface. A guideway in the rotor is disposed at an angle to the grinding surface and is located such that, as the rotor rotates, the guideway sweeps over the portion of the grinding surface in contact with the stock to be ground. A sealing bar is located in the guideway, the bar being of a material softer than the grinding surface so that it can be worn down into conformity with the surface. A rack within the guideway is connected to the sealing bar, and a pinion engages the rack. The rotational position of the pinion can be incrementally adjusted to advance the sealing bar toward the grinding surface, and the play between the rack and the pinion is sufficient to allow the sealing bar to be worn into substantial conformity with the grinding surface after the surface has been sharpened.

6 Claims, 3 Drawing Sheets

SEALING BAR FOR CENTRIFUGAL GRINDERS

This invention relates generally to centrifugal grinders for pulp wood or wood chips, and has to do particularly with an improvement in centrifugal grinders in the form of a wearable sealing bar at the trailing edge of the chip pocket in the rotor, the purpose of which is to retain wood particles in the grinding zone until they are fibre-sized and can pass beneath the sealing bar.

BACKGROUND OF THIS INVENTION

My own earlier U.S. Pat. No. 4,474,335, issued Oct. 2, 1984 and entitled "Apparatus for Centrifugal Pulp Wood and Wood Chip Grinding" discloses the basic centrifugal grinder. The grinder incorporates an internal grinding surface in the shape of a surface of revolution, with a rotor mounted coaxially within the grinding surface. The rotor has a central cavity which can receive pulp wood or wood chips, and means defining at least one pocket through which material in the central cavity can pass to and contact the grinding surface. A prime mover rotates the rotor with respect to the stationary internal grinding surface.

The centrifugal grinder described in my earlier U.S. Pat. No. 4,474,335 works very satisfactorily. However, with some materials, too many rejects (chip ends and fibre bundles) are produced, and it is desirable to improve the design in such a way as to eliminate or reduce the number of rejects.

GENERAL DESCRIPTION OF THIS INVENTION

In simple terms, this invention provides a sealing bar located at the trailing edge of the chip pocket or pockets, the purpose of which is to retain wood particles in the grinding zone until they are fibre-sized and can pass beneath the sealing bar enmeshed in the stone surface. Since the stone surface is often irregular, and since a minimum gap must obviously be maintained between the stone and the sealing bar in order to be effective, the bar has been designed to be sacrificial. In order to incrementally advance the sealing bar toward the stone surface, there is employed a rack and pinion mechanism with a certain amount of play between the engaging teeth. With the rotor stationary, the sealing bar is advanced into contact with the grinding surface, and then the rotor is rotated to allow the sealing bar to grind itself into conformity with the grinding surface. The grinding pressure for the sealing bar arises through centrifugal force, and the sealing bar moves outwardly a small amount to take up the slack between the rack and pinion teeth. When the slack has been taken up, the sealing bar will be as perfect a fit as is possible with the stone surface.

More particularly, this invention provides a centrifugal grinder for pulpwood and wood chips, which includes a stationary grinding surface shaped as an internal surface of revolution, and a rotor inside the grinding surface mounted for rotation about the axis of the surface. Motive means are provided for rotating the rotor, and in the latter is provided a substantially axial feed passage along which stock to be ground can be fed into the rotor, and at least one passageway extending from the passage to the grinding surface. A guideway in the rotor is disposed at an angle to the grinding surface, the guideway being disposed such that, as the rotor rotates, the guideway sweeps over the portion of the grinding surface in contact with the stock to be ground. A sealing bar is positioned in the guideway, the sealing bar being of a material softer than the grinding surface so that it can be worn down into conformity with that surface. The sealing bar is connected to a rack means, and the latter is movable toward and away from the grinding surface to allow the sealing bar to be displaced toward the surface as the bar is worn. A pinion engages the rack means, and the apparatus incorporates adjustment means for incrementally adjusting the rotational position of the pinion means to advance the sealing bar toward the grinding surface. The play between the rack means and the pinion is sufficient to allow the sealing bar to be worn into conformity with the grinding surface after the surface has been sharpened.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
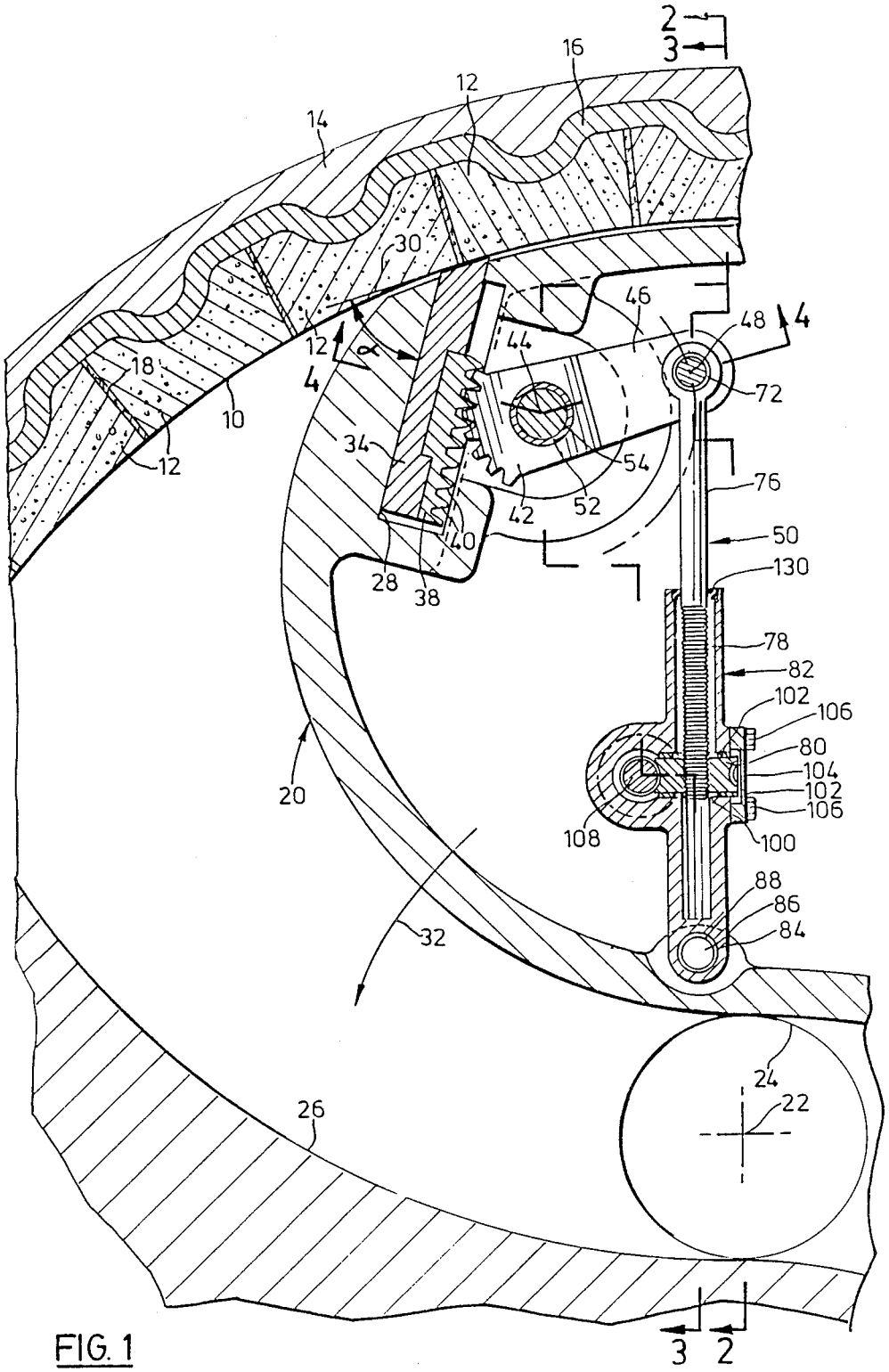
FIG. 1 is a partial cross-sectional view through a centrifugal grinder, illustrating the improvement of this invention.

Attention is first directed to FIG. 1, which is a partial cross-sectional view through a centrifugal grinder suitable for grinding pulpwood and wood chips. The centrifugal grinder shown in the figure includes a stationary grinding surface 10, which is the inside surface defined by a plurality of grinding stones 12 that are held in place against a ductile iron outer sleeve 14, with a layer of grout 16 between the sleeve 14 and the stones 12. A layer of cork 18 is provided between each adjacent pair of stones 12. Within the stationary grinding surface 10, a rotor 20 is mounted for rotation about an axis 22, which is coincident with the centre of curvature for the stationary grinding surface 10. Motive means such as an electrical motor (not shown) is provided for rotating the rotor 20.

As seen in FIG. 1, the rotor has a substantially axial feed passage 24 along which stock to be ground, such as pulpwood or wood chips, can be fed into the rotor 20. The rotor further has at least one, and typically two, passageways 26 extending from the passage 24 to the grinding surface 10. Thus, in operation, the rotor 20 is rotated and stock to be ground is fed into the passage 24. When it reaches the passageway 26, centrifugal force carries the stock outwardly along the passageway 26, and the same centrifugal force urges the stock against the stationary grinding surface 10 as the rotor 20 rotates. This accomplishes the necessary grinding of the stock.

The rotor 20 incorporates a guideway 28 which is disposed at an angle to the grinding surface 10, and is situated in such a way that, as the rotor 20 rotates, the guideway 28 sweeps over the portion of the grinding surface 10 which is in contact with the stock being ground. More particularly, as seen in FIG. 1, the angle $\alpha$ between the guideway 28 and a hypothetical plane surface 30 which is tangent to the grinding surface 10 at the location of the guideway, is acute when seen from a position ahead of the position of the guideway in the rotational sense. The arrow 32 shows the rotor 20 rotating in the counter-clockwise sense, as pictured in FIG. 1. In the embodiment illustrated, the angle $\alpha$ is approximately 59°.

Figure 4:
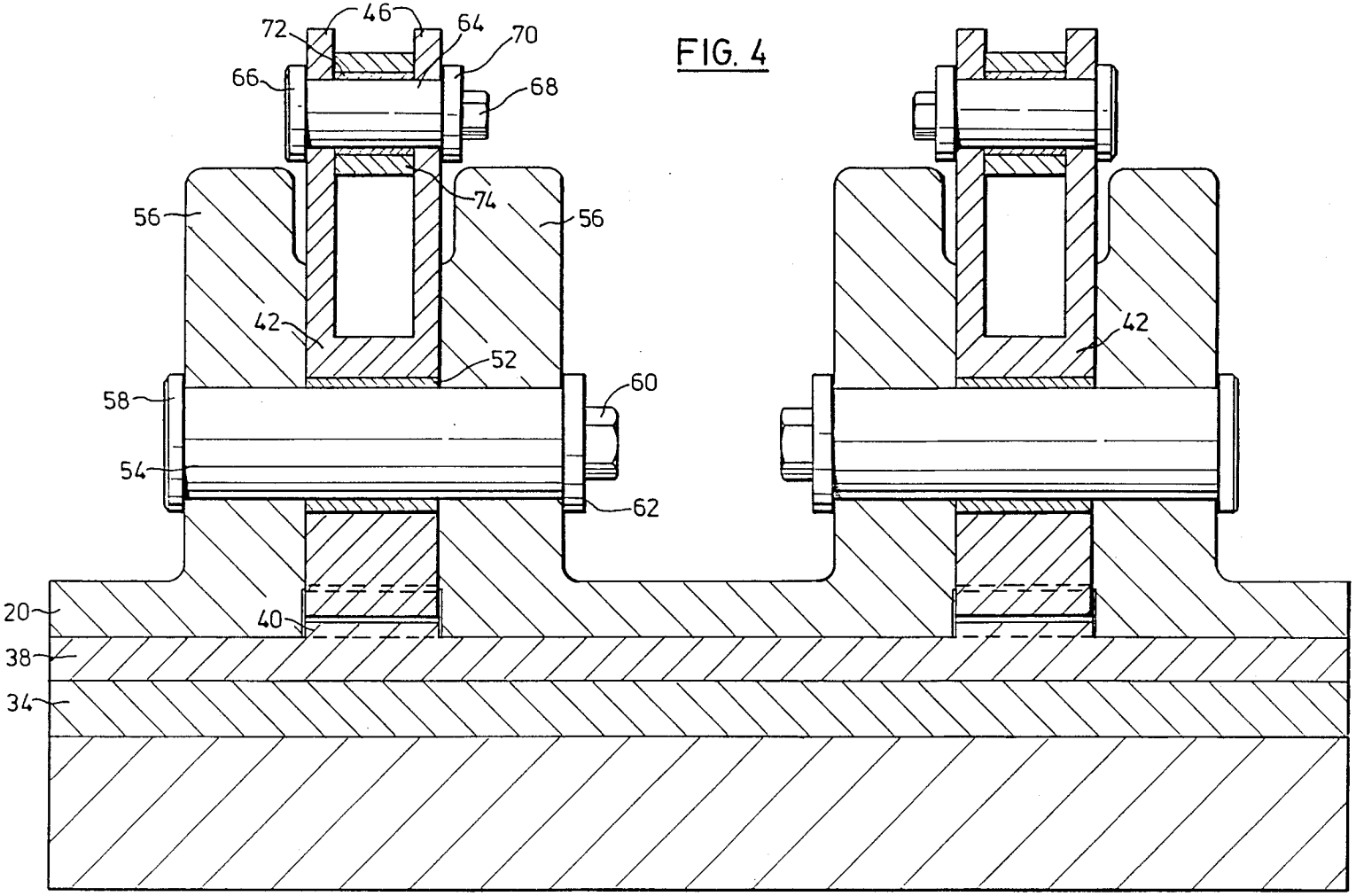
FIG. 4 is a sectional view taken at the line 4—4 in FIG. 1.

Located in the guideway 28 is a sealing bar 34, which runs the length of the rotor (in the direction perpendicular to the drawing paper). The sealing bar 34 is in engagement with an elongate rack 38, having a plurality of teeth 40. As can be seen, the rack has a stepped configuration for engagement with the sealing bar 34. The rack engages a pinion 42 mounted for rotation about an axis 44. The pinion 42 has an integral extension 46, which is forked as can be seen in FIG. 4. Pivotally connected to the extension at an axis 48 parallel to the axis 44 but remote therefrom is an arm 50 of which the length can be adjusted manually. By adjusting the length of the arm 50, the rotational position of the pinion 42 with respect to the rotor 20 may be adjusted, which in turn moves the rack 38 toward or away from the stationary grinding surface 10, carrying the sealing bar 34 along with it.

Having explained the general configuration and function of the various major components shown in FIG. 1, it is now appropriate to describe the specific construction in greater detail.

Looking at FIGS. 1 and 4 together, the pinion 42 can be seen to be mounted about a bushing 52 which in turn is mounted about a shaft 54. The shaft extends through aligned bores in two parallel flanges 56 which are integral with the rotor 20. The pin 54 has an integral head 58 at one end, and a threaded axial bore at the other end (not seen) which receives a bolt 60. A washer 62 is interposed between the head of the bolt 60 and the outside surface of the respective flange 56.

Figure 2:
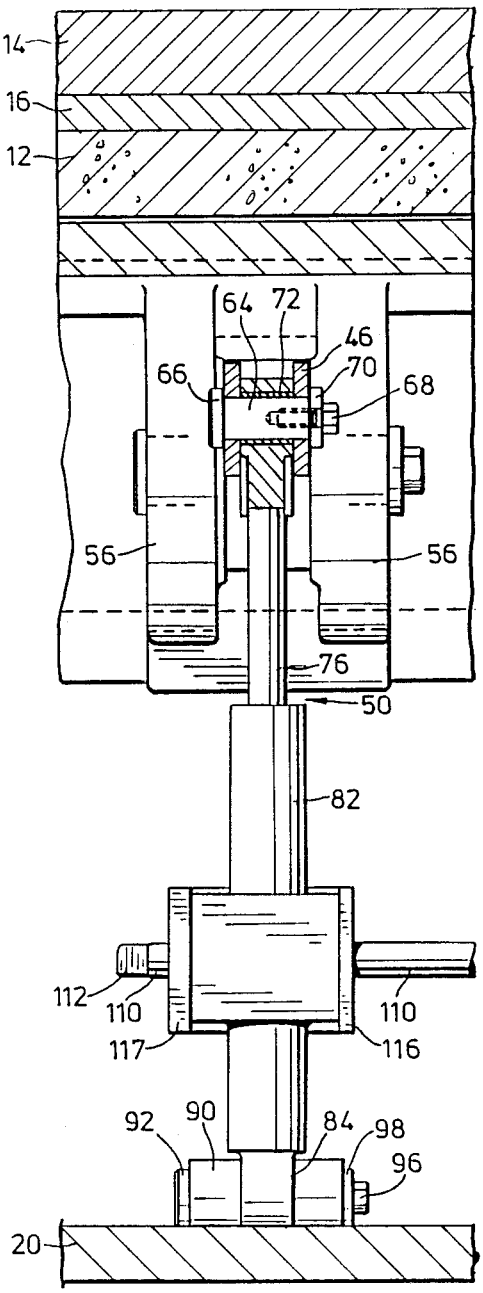
FIG. 2 is a partial longitudinal sectional view taken at the line 2—2 in FIG. 1.
Figure 3:
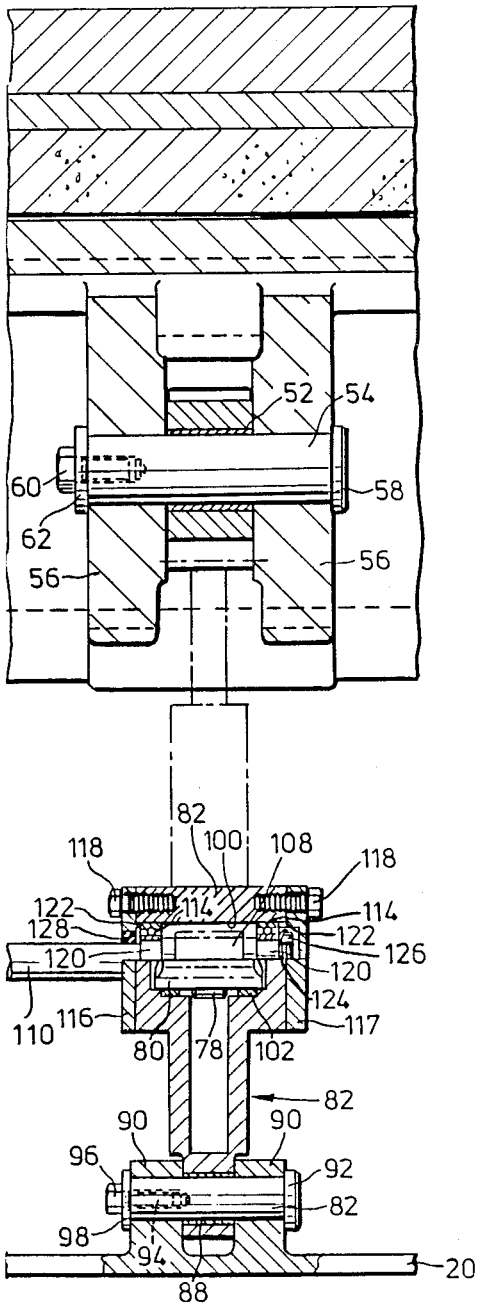
FIG. 3 is a sectional view taken at the line 3—3 in FIG. 1.

Toward the extremity of the forked extension 46 (close to the top in FIG. 4) is a further pin 64 passing through aligned bores in the extension 46. The pin 64 has a similar construction to that of the pin 54, including an integral head 66 at one end, and at the other a threaded bore (not seen) which receives a bolt 68 bearing against a washer 70. Around the pin 64 is provided a bushing 72, which in turn is surrounded by the cylindrical upper end 74 of a first portion 76 of the arm 50. The first portion 76 is externally threaded at its lower end 78, and this threaded part engages a threaded axial bore in a worm wheel 80. A housing 82 is provided and constitutes a second portion of the arm 50. The housing 82 has its lower end 84 pivotally mounted with respect to the rotor 20 by means of a pin 86 surrounded by a bushing 88. As can be seen in FIGS. 2 and 3, the pin 82 extends through two aligned bores in a pair of flanges 90 which extend integrally from the rotor 20. The pin 82 has a head 92 at one end, and has a threaded axial bore at the other for receiving a bolt 94 which has a head 96. A washer 98 is interposed between the head 96 and the respective flange 90.

The housing 82 provides a chamber 100 within which the worm wheel 80 is received. Slip rings 102 are provided to allow a low-friction support for the worm wheel 80. A closure plate 104 closes the chamber 100 on the rightward side as pictured in FIG. 1, the closure plate 104 being secured in place by bolts 106.

The worm wheel 80 is engaged by a worm 108 which is connected to a shaft 110. At the leftward end of the shaft 110 (see FIG. 2) there is a squared end 112 for engagement by an appropriate cranking tool. The shaft 110 is supported within the housing 82 by bearings 114, and this bearing and worm assembly can be removed from the housing 82 by sliding it longitudinally off the shaft 110 after removal of cover plates 116 and 117 following removal of securement bolts 118. As can be seen in FIG. 3, the shaft 110 has two intermediate steps 120 for receiving the bearings 114, and the latter are held in place by inward ribs 122 on the cover plates 116 and 117. The rightward bearing 114 is held in place with respect to the shaft 110 by virtue of a threaded end portion 124 of the shaft 110 being engaged by a nut 126. A seal 128 around the shaft 110 prevents extraneous materials from entering the cavity 100 through the plate 116.

Returning to FIG. 1, a seal 130 around the portion 76 of the arm 50 prevents ingress of extraneous materials into the interior of the housing 82.

A preferred material for the sealing bar 34 is nylon. Tests have shown that when a nylon sealing bar is being ground into conformity with the surface 10, the waste material (nylon) is reduced to a powder, and has no denigratory effect on the stone. It is important that the material of the sealing bar 32 not be caused to melt by the grinding procedure, as this would cause it to adhere to the stone surface and spoil the surface for wood grinding purposes. Naturally, any other plastic or similar material which can be ground into conformity with the surface 10 without melting would be a satisfactory alternative. This invention is not considered limited to the use of nylon.

DESCRIPTION OF OPERATION

As pointed out previously, the purpose of the sealing bar 34 is to retain wood particles in the grinding zone at the outer extremity of the passageway 26 until they are fibre-sized and can pass beneath the sealing bar enmeshed in the stone surface. The bar 34 is designed to be sacrificial due to the fact that the stone surface is often irregular.

The sealing bar 34 is first inserted into the guideway 28 longitudinally after affixing it to the rack 38. The teeth 40 of the rack 38 are provided at discrete locations to coincide with the position of the teeth of the two pinions 42 when the rack and sealing bar are in place. Prior to insertion for the first time, the pinion 42 is placed approximately in the position shown in FIG. 1, with the arm 50 at substantially maximum extension.

When the sealing bar is in place, the arm 50 is then shortened by cranking the end 112 of the shaft 110, thus turning the worm 108 which in turn rotates the worm wheel 80, thereby drawing the first portion 76 of the arm 50 downwardly into the housing 82. This in turn will rotate the pinion 42 in the clockwise direction as pictured in FIG. 1, moving the rack 38 and the sealing bar 34 outwardly along the guideway 28 and toward the stationary grinding surface 10.

The ends of the rotor 20 are then closed, if necessary, by plates, and the rotor is rotated in order to allow centrifugal force to move the sealing bar 34 outwardly against the stationary grinding surface 10. There is deliberately provided a certain amount of play between the teeth of the rack 38 and the teeth of the pinion 42, to allow the sealing bar to move incrementally outwardly during this grinding procedure, thus permitting it to grind itself into conformity with the stationary grinding surface 10.

The centrifugal grinder may now be utilized in the usual way for grinding pulp wood or wood chips. After a certain number of uses, the grinding surface 10 will need to be dressed or sharpened. After the stone is sharpened (which enlarges the diameter), the irregularities of the stone will have changed and it will be necessary to again cause the sealing bar 34 to be ground into conformity with it. In order to do so, the procedure that is followed is the same as that described for the initial "grinding in" procedure. Thus, an increment of the sealing bar 34 will be sacrificed following each stone sharpening. However, by allowing enough material at the outward edge of the sealing bar 34, the bar can be used for several cycles. For example, if roughly one eighth of an inch is sacrificed at each sharpening, and it is desired to allow for sixteen such incremental adjustments in the bar, then the bar would have to be designed with two inches of total wear allowance. If the mean time between stone sharpenings is three weeks, then the bar life, in the example just given, can be expected to be about forty-eight weeks.

Each time the angular position of the pinion 42 is adjusted with respect to the rotor 20, the shaft 110 is locked into position.

It will be understood that the play between the rack 38 and the pinion 42 can be arranged to be greater than normal for teeth of this kind, in order to ensure that the sealing bar 34 will grind itself into conformity with the grinding surface 10 when the pinion 42 is set.

While one embodiment of this invention has been illustrated in the accompanying drawings and described hereinabove, it will be evident to those skilled in the art that changes and modifications may be made therein without departing from the essence of this invention as set forth in the appended claims.

The embodiments of the invention in which an exclusive property or privilege is claimed are defined as follows:

1. A centrifugal grinder for pulp wood and wood chips, comprising:

a stationary grinding surface shaped as an internal surface of revolution, a rotor inside the grinding surface mounted for rotation about the axis of the surface, and motive means for rotating the rotor, the rotor having a substantially axial feed passage along which stock to be ground can be fed into the rotor, and at least one passageway extending from said passage to the grinding surface, a guideway in the rotor disposed at an angle to the grinding surface, the guideway being disposed such that, as the rotor rotates, the guideway sweeps over the portion of the grinding surface in contact with the stock to be ground, a sealing bar in said guideway, the sealing bar being of a material softer than the grinding surface so that it can be worn down into conformity with that surface, rack means to which the sealing bar is mounted, the rack means being movable toward and away from the grinding surface to allow the sealing bar to be displaced toward the surface as the bar is worn, pinion means in engagement with the rack means, and adjustment means for incrementally adjusting the rotational position of the pinion means to advance the sealing bar toward the grinding surface, the play between the rack means and the pinion means being sufficient to allow the sealing bar to be worn into substantial conformity with the grinding surface after the surface has been sharpened.

2. The invention claimed in claim 1, in which the sealing bar and the rack means extend along the rotor axially with respect to the grinding surface.

3. The invention claimed in claim 1, in which the sealing bar is made of a plastic material.

4. The invention claimed in claim 1, in which the pinion means comprises two pinions, one adjacent either end of the rotor, and in which the adjustment means comprises, for each pinion, a first arm fixed with respect to the pinion, and a second arm having one end connected to the first arm at a location remote from the pinion axis, and the other end pivotally mounted to the rotor, the second arm being of adjustable length.

5. The invention claimed in claim 4, in which said second arm has a first portion including said one end of the second arm, and a second portion including said other end of the second arm, a worm wheel axially fixed with respect to the second portion but rotatable with respect thereto, a worm engaging said worm wheel, the worm being manually rotatable to rotate the worm wheel, the worm wheel having a threaded axial bore, said first portion of the second arm being integral with a threaded shaft engaging said threaded axial bore, whereby manual rotation of the worm causes said first portion to move axially with respect to the second portion thereof.

6. The invention claimed in claim 1, in which the angle between the guideway and a plane surface tangent to the grinding surface is acute when seen from a position ahead of the position of the sealing bar in the rotational sense.

* * * * *